United States Patent [19]

Van Horne et al.

[11] 4,239,405

[45] Dec. 16, 1980

[54] FORM ALIGNING KNOB

[75] Inventors: Arthur C. Van Horne, Santa Clara; James E. Young, La Honda, both of Calif.

[73] Assignee: Dataproducts Corporation, Woodland Hills, Calif.

[21] Appl. No.: 2,694

[22] Filed: Jan. 11, 1979

[51] Int. Cl.[3] ..... B41J 15/00

[52] U.S. Cl. ..... 400/616.1; 400/556; 400/545; 400/648

[58] Field of Search ..... 400/47, 447, 434, 2, 400/545, 555, 556, 556.1, 556.2, 556.3, 556.4, 557, 558, 559, 559.1, 560, 560.1, 560.2, 561, 562, 563, 564, 564.1, 569, 576, 583.2, 583.4, 585, 585.1, 616.3, 648, 650, 651, 659, 616.1

[56] References Cited

U.S. PATENT DOCUMENTS

| | | | |
|---|---|---|---|
| 800,729 | 10/1905 | Farnum | 400/556 X |
| 3,452,853 | 7/1969 | Mabon | 400/583.4 X |
| 3,474,889 | 10/1969 | St. Lawrence Dannatt | 400/527.1 |
| 3,605,979 | 9/1971 | St. Lawrence Dannatt | 400/47 X |

*Primary Examiner*—Ernest T. Wright, Jr.

[57] ABSTRACT

In a printing device, including a drive means such as a stepping means and a driven shaft for advancing a form, a form aligning mechanism comprises a generally cylindrical hollow knob mounted concentrically with the driven shaft by a mounting means which converts a force of sufficient magnitude applied in almost any direction to the generally cylindrical hollow knob into a longitudinal displacement of the driven shaft so as to disengage tne driven shaft from the drive means, thereby permitting fine adjustment of the vertical position of the form in the printing device.

3 Claims, 10 Drawing Figures

FORM ALIGNING KNOB

BACKGROUND OF THE INVENTION

1. Field of the Invention

This invention pertains generally to the field of mechanical printing devices, as opposed to photostatic printing or copying devices, in which a page or form is typically advanced lengthwise in a stepping manner. More particularly, this invention relates to the mechanism which disengages the paper feed driven shaft from the drive mechanism thereby permitting the shaft to be freely rotated to effect a fine adjustment of the vertical position of the paper.

2. Prior Art

The present invention is intended to operate in high speed printing devices. In the typical high speed printing device, the paper form on which the printing takes place, is advanced vertically down its length by a form advancing mechanism which is activated by a driven shaft powered by a drive means. Generally, the driven shaft is horizontally oriented. The operation of one such form advancing mechanism is more thoroughly described in U.S. Pat. No. 3,452,853 issued July 1, 1969 to Stuart Mabon. The form advancing mechanism mentioned herein is similar but not identical to the referenced mechanism. Generally to advance the form, a signal is transmitted to a drive means, which may be a stepping motor means, which rotates a driven shaft causing the form advancing mechanism to engage and advance the form, as in the U.S. Pat. No. 3,452,853 to Stuart Mabon. In order to advance the form in other than a stepping manner, the driven shaft must be longitudinally displaced so as to disengage it from the stepping or other drive means and the driven shaft must then be manually rotated to the desired position. Thus, two motions are required, one longitudinally directed, the other rotationally directed.

There are several prior art mechanisms designed to produce these two motions and thereby permit fine adjustment of the vertical position of a form within a printing device.

One popular mechanism comprises a knob with a "button" in the end of the knob. This type is commonly used on typewriters. The longitudinal displacement is achieved by depression of the "button" in a direction coincident with the axis of the driven shaft. The rotation is achieved by rotating the knob while the button is depressed. This type of mechanism requires the coordinated use of the thumb (to depress the button) and likely two fingers (to rotate the knob). When the botton of this mechanism is released, the driven shaft is automatically reengaged with the drive means.

Another prior art mechanism also common on typewriters is such that the knob itself also serves the function of the button. A single knob is pushed (or pulled) in a direction coincident with the longitudinal axis of the driven shaft thereby laterally displacing the shaft and disengaging it from the drive means. The knob is then freely rotatable so as to advance and finely adjust the vertical position of the form. Again, the use of more than one digit is required, and with this mechanism it is likely that four or maybe all five digits of the operator's hand will be used. With this mechanism the driven shaft is reengaged with the drive means only after the entire knob is pulled (or pushed) back to its original position.

A third mechanism which is designed to effect a longitudinal displacement of the driven shaft followed by rotation of the shaft is a rather complicated device comprising a knob having levers or handles which are squeezed, pushed, or pulled to produce the longitudinal displacement and then the entire knob is rotated to finely adjust the vertical position of the form. This mechanism also requires the use of more than one digit and the application of forces in different directions. With this mechanism the driven shaft is automatically reengaged with the drive mechanism upon release of the levers or handles.

Each of these prior art mechanisms suffer from some common disadvantages. Each mechanism requires more than one motion of the hand or fingers to make the fine adjustment. A first horizontal motion is required to disengage the driven shaft from the drive mechanism. A second rotational motion is required to effect the fine adjustment of the vertical position of the form. Another common disadvantage is that the operator must apply a force in a difficult and unnatural direction. Generally the operator of the printing device is seated facing the device. To effect the longitudinal displacement of the driven shaft, the operator must extend his arm from his body and generate a horizontal force of sufficient magnitude to activate the mechanism. To generate a horizontal force directed across the body is in itself an unnatural and uncomfortable action. Additionally, if the operator is seated in a swivel chair, unless his feet are firmly planted on the floor, he may be caused to rotate slightly in his chair as a reaction to generating the force. Another disadvantage is that because the arm of the operator is likely extended so as to reach the machine, the operator must overcome the substantial mechanical disadvantage of his extended arm. That is, significant effort of the operator's pectoral muscles must be exerted to generate a relatively small force at the end of his fingers.

Two of these prior art mechanisms exhibit a third disadvantage. These mechanisms require the operator to grasp the device in a specific place or to apply a force at a small specific location. A specific button must be pushed, or a specific lever must be thrown.

Each of these prior art mechanisms requires the use of more than one digit in order to disengage the driven shaft from the drive means and advance the paper.

It is thus an object of the present invention to provide a mechanism, to disengage the driven shaft from the motor or other drive means thereby permitting fine adjustment of the vertical position of the form in the printing device, which does not require the operator to exert a horizontal force directed across the body of the operator.

It is a further object of the present invention to provide such a mechanism which can effect the fine vertical adjustment of the form in response to a single motion of a single digit of the operator.

It is another object of the present invention to provide such a mechanism which can effect the fine vertical adjustment of the form in response to a force applied over a wide range of locations on the mechanism and applied in any one of a plurality of directions.

SUMMARY OF THE INVENTION

The mechanism of the present invention comprises a hollow knob concentrically mounted about a portion of the driven shaft of the paper advancing mechanism. Also mounted concentrically about the driven shaft is a hub member. The hub member is a mounting means for the driven shaft, and is in close fitting relationship with the driven shaft and positioned between the knob and driven shaft. The driven shaft is seated in the hub member which is mounted in a bearing member for easy rotation. The hub member and driven shaft are connected so as to rotate as a unit. The knob is mounted upon the hub member by means of a yoke device which serves as a universal joint permitting the knob to pivot about the hub member in any angular orientation subject only to the physical extensions of the knob and hub. The generally cylindrical hollow knob is spring biased such that one end is, in its normal state, held in contact against a fixed reference such as the frame of the printing device (or a bearing member mounted thereon). The other end of the knob is capable of being displaced as a result of a force applied to the knob from almost any direction. Since the one end of the knob is biased against the frame, the displacement of the other end in a radial direction will cause the knob to pivot at the one end. This pivoting motion is converted by the universal joint yoke member into a longitudinal displacement of the hub member which displacement is transmitted through a spring member to cause the driven shaft to longitudinally displace, thereby disengaging the driven shaft from the drive mechanism. When the force is removed from the knob, the spring bias causes the knob to return to its normal position thereby automatically reengaging the driven shaft with the drive means.

BRIEF DESCRIPTION OF THE FIGURES

FIG. 8 is a sectional view of the hub member taken along the line 8—8 of FIG. 7.

DETAILED DESCRIPTION OF THE INVENTION

Figure 10:
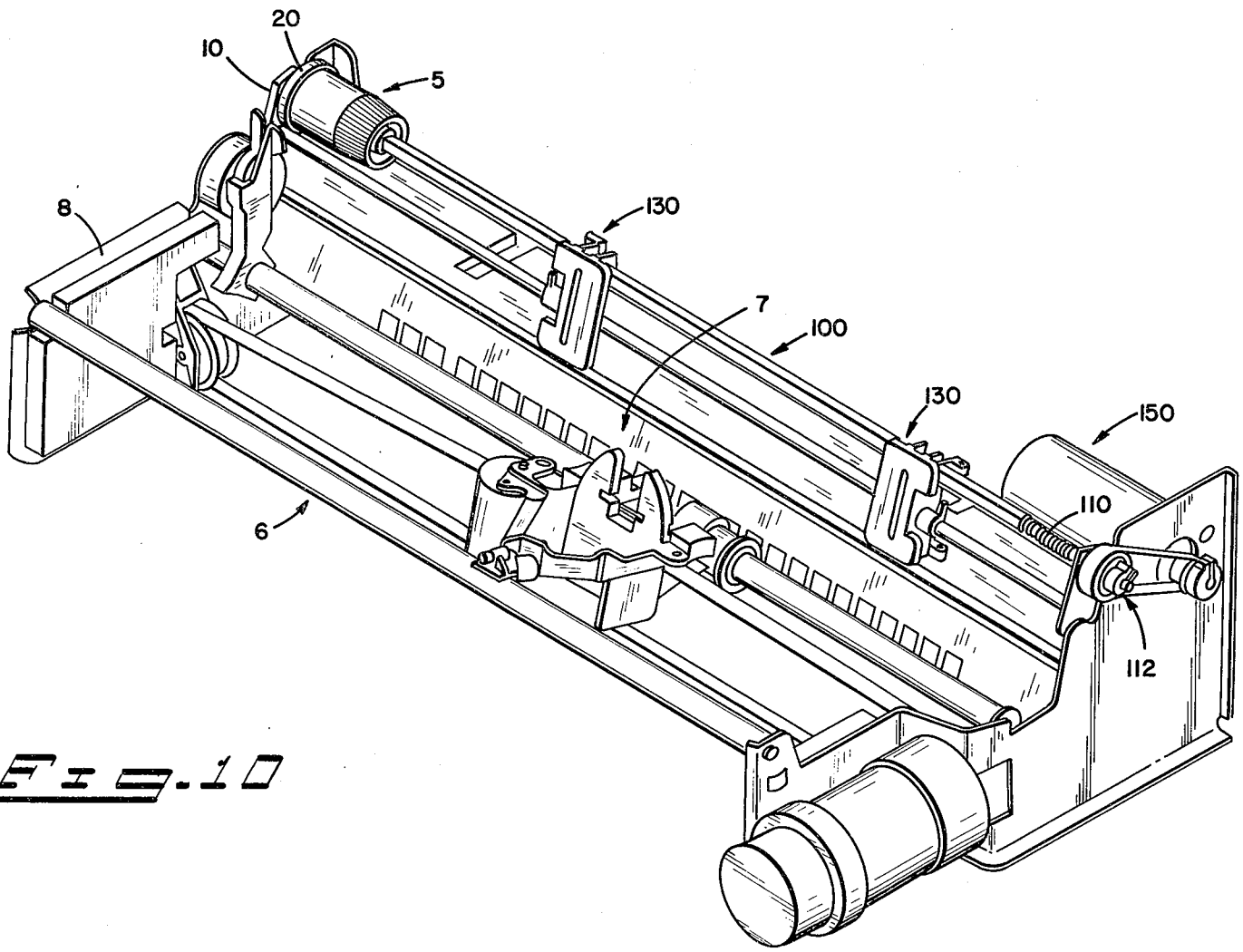
FIG. 10 shows the surrounding environment in which the present invention is generally intended to operate.

The form aligning mechanism 5 of the present invention is typically operated in a printing device 6 having a platen 7, a paper advancing mechanism including a driven shaft 100, a drive means 150 and a paper gripping mechanism 130 as shown in FIG. 10. Reference may be made to U.S. Pat. No. 3,452,853 to Mabon issued July 1, 1969 for a better understanding of the paper feed mechanism with which the present invention is intended to cooperate.

The inventive form aligning mechanism 5 includes a generally cylindrical hollow knob 70 which is mounted by a universal joint assembly to a hub 30 which supports an end of the driven shaft 100. To adjust the position of the form, the operator exerts finger pressure against the knob 70 in any direction, as for example downward as indicated by the arrow 60 in FIG. 2. This pressure causes the knob 70 to pivot about a point on a vertical support surface 24. The resultant pivotal motion is transmitted through the universal joint assembly to cause axial displacement toward the right of the driven shaft 100. This activates the release mechanism 112 (see FIG. 10) which disengages the shaft 100 from its normal motor drive mechanism 150 and thereby allows the shaft 100 to be freely rotated. The operator then can adjust the form position by slightly rotating the knob 70. This rotational motion is transmitted through the universal joint assembly to the shaft 100 and accomplishes the desired free rotation of the form advancing mechanism and effects proper form alignment. When the operator removes the finger pressure from the cylindrical knob 70, a bias spring 110 urges the knob 70 back into its rest position (FIG. 1) and axially biases the shaft 100 back into engagement with the stepping or other drive means 150.

Figure 1:
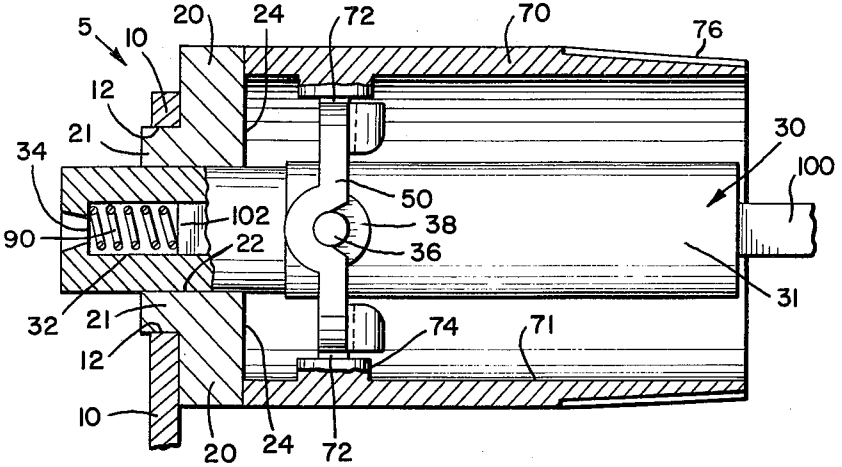
FIG. 1 is a cutaway view illustrating the construction of the form aligning knob of the present invention in its normal position.

FIG. 1 shows a cutaway view of the assembled form aligning mechanism 5 of the present invention. The mechanism 5 is attached to a rigid portion of the printing device 6, such as the frame 8, by means of a bracket, such as bracket 10. This bracket 10 has a bore 12 extending through its thickness for receiving a bearing member 20. The bearing member 20 is provided with an axially extending shoulder 21 which mates with the bore 12 of bracket 10 thereby securing the bearing member 20 to the frame member 8 (shown in FIG. 10). The bearing member 20 is provided with an axially extending bore 22 (shown in FIG. 3) for receiving the hub 30. The cylindrical surface of bore 22 is a bearing surface for hub 30 and allows hub 30 to rotate freely therein in response to the rotation of driven shaft 100 and in response to rotation of knob 70. Surface 24 of bearing member 20 serves as a resting surface for one end of knob 70. When the other end of knob 70 is radially displaced, the one end pivots on a point located on surface 24 of the bearing member 20.

Extending axially through an end portion of hub 30 is a rectangular bore 32 for receiving the similar rectangular end 102 of driven shaft 100. The interior end wall 34 of the rectangular bore 32 is linked to the end 102 of driven shaft 100 by a spring 90. This spring 90 transmits longitudinal displacement of hub 30 to driven shaft 100. The spring 90 is almost fully compressed to its solid length when knob 70 is in its normal position. The purpose of the spring 90 is to eliminate most of the free play or slop in tolerances between the elements linking the printer drive means 150 and driven shaft 100. The assembled printer is adjusted so that when the form aligning knob 70 is not displaced, the spring 90 is compressed to within approximately 1 millimeter (0.04 inches) of its solid length. The first millimeter of horizontal displacement of knob 70 compresses the spring 90 to its solid length, further horizontal displacement of knob 70 causes horizontal displacement of driven shaft 100 through compressed spring 90.

On the exterior cylindrical wall 31 of hub 30 are mounted two pivot pins 36, each of which sit on a base 38. These pins 36 are located 180 degrees apart. On the interior cylindrical wall 71 of knob 70, also spaced 180 degrees apart are two pivot pins 72 each of which sits on a base 74 and has a flat surface 72' extending lengthwise thereof. The pivot pins 36 and 72 cooperate by means of a yoke 50. The yoke 50 is provided with suitable cradles 52 and 54 (shown in FIG. 6) such that when the pivot pins 36 and 72 are mounted therein, hub 30 and knob 70 are effectively joined by a universal joint.

Figure 2:
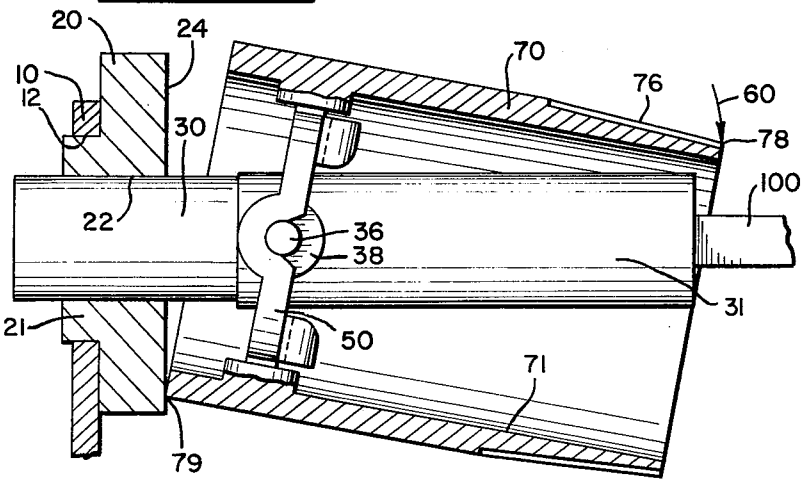
FIG. 2 is a cutaway view illustrating the form aligning knob in its displaced or pivoted position illustrating the longitudinal displacement of the hub member.

FIG. 2 illustrates the position assumed by the above described form aligning mechanism 5 in response to the application of a force such as indicated by arrow 60 to the knob 70. Because the knob 70 is spring biased to remain in contact with surface 24 of bearing member 20, application of a force to the free end of knob 70 as indicated at point 78 by the arrow 60, will cause the entire knob 70 to pivot about a point 79 located 180 degrees around the knob 70 from the point 78 of application of the force at the opposite end of knob 70. The application of the force will also cause the pivot to travel slightly radially inwardly as the knob 70 pivots further and further. This pivoting of knob 70 causes a longitudinal displacement of the knob 70, yoke 50 and hub 30 which results in longitudinal displacement of the driven shaft 100. The driven shaft 100 is thus disengaged from the drive means 150 (see FIG. 10) and rotation of the knob 70 will effect a fine adjustment of the alignment of the form.

Figure 3:
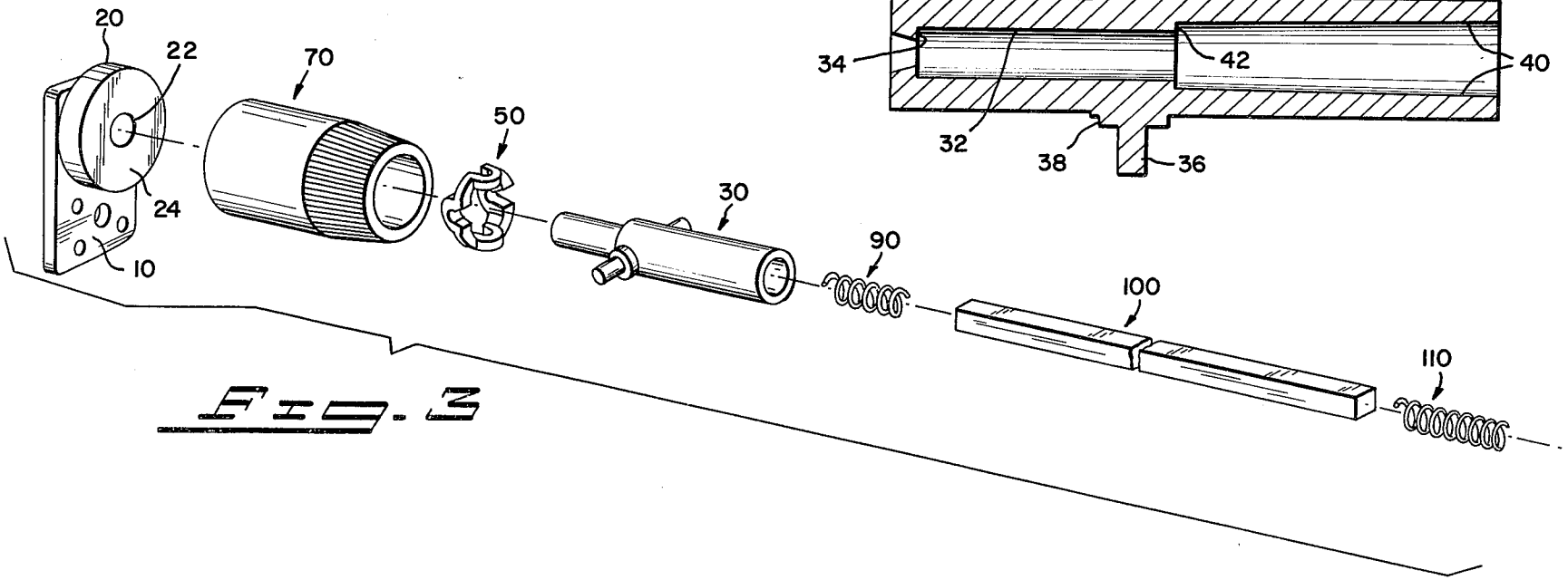
FIG. 3 is an exploded view of the elements comprising the form aligning knob.

FIG. 3 shows the simplicity of construction of the form aligning mechanism 5. The key to the proper operation of the mechanism 5 lies in the cooperative action of the generally cylindrical hollow knob 70, yoke 50 and hub 30. The bracket 10 and bearing member 20 serve to mount and align the driven shaft 100. The spring 90 joins hub 30 and driven shaft 100 permitting longitudinal movement of the hub 30 to be transferred to the driven shaft 100. Driven shaft 100 is shown as being spring biased by spring 110 which biasing serves to maintain the cylindrical hollow knob 70 in contact with surface 24 and to return the knob 70 to its normal contact with surface 24 upon removal of the force 60 from the knob 70.

Figure 4:
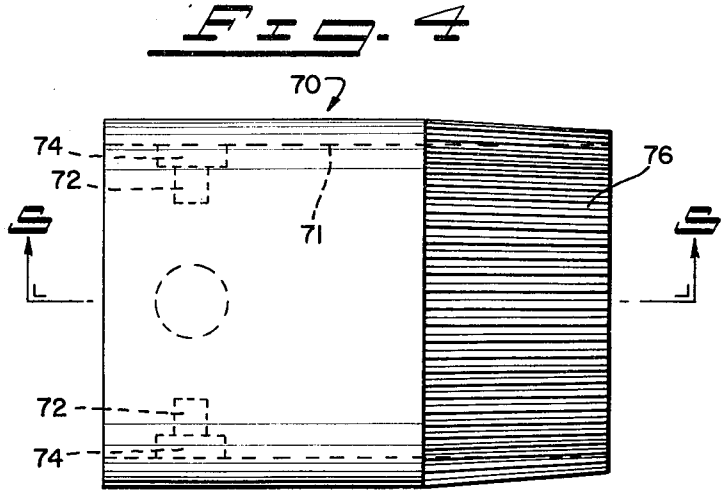
FIG. 4 is a detail view of the knob.
Figure 5:
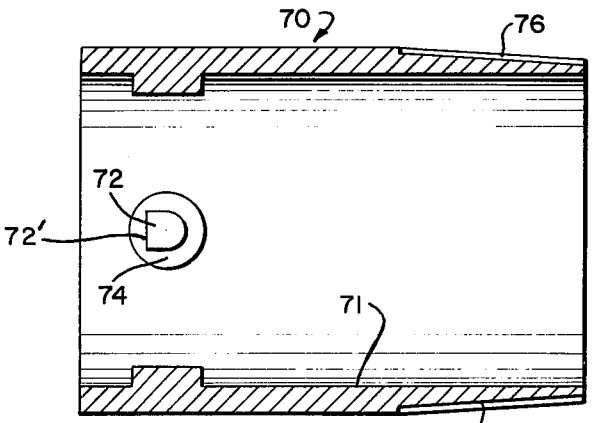
FIG. 5 is a sectional view of the knob taken along the line 5—5 of FIG. 4.

The knob 70 is more clearly illustrated in FIGS. 4 and 5. The knob 70 is generally cylindrical in shape and is hollow, having an interior cylindrical surface or wall 71. Although generally cylindrical, the shape of the knob 70 is not required to be so, and any conventional shape for the knob 70 can serve as well. On the interior wall 71 are provided a pair of mounting pins 72 seated on a mounting base 74. The two mounting pins 72 are spaced directly opposite one another so as to form a pivoting axis which lies perpendicular to and passes through the longitudinal axis of the knob 70. The mounting base 74 is preferably circular in cross-section as shown in FIG. 4 whereas the pivot pins 72 preferably have a cross-section with only one side having a circular curvature. This is to aid in proper installation of the yoke 50. The cradle 52 or 54 of yoke 50 must be installed in knob 70 such that the curved portion of pin 72 is seated in contact with the cradle 52, otherwise yoke 50 may not operate as an effective universal joint. The exterior cylindrical surface of knob 70 is provided at its non-pivoted end with a plurality of axially extending ridges 76 or other suitable high friction surface texture.

Figure 6:
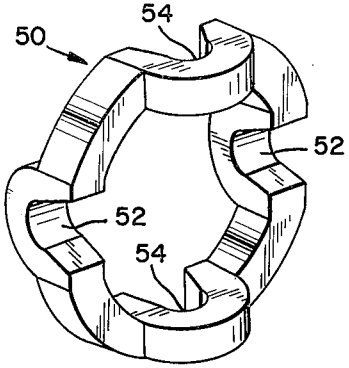
FIG. 6 is a perspective view of the yoke which functions in a manner similar to a univeral joint.

The knob 70 is pivotally mounted by means of pivot pins 72 onto the yoke 50, shown in FIG. 6. The yoke 50 is generally annular in shape and provided with pairs of cradles 52 and 54 for seating the pivot pins 72 of knob 70 and the pivot pins 36 of hub 30. The axial centerline of the pairs of cradles 52 and 54 intersect one another at right angles and also intersect the longitudinal axis of the driven shaft 100 at right angles. The pivot pins 72 of the knob 70 are seated into one pair of cradles such as 54 and the pivot pins 36 of hub 30 are seated into the other pair of cradles 52. Proper seating of the pivot pins 36 and 72 into the cradles 52 and 54 results in the formation of a universal joint between knob 70 and hub 30. A detailed description of the operation of this universal joint is given infra.

Figure 7:
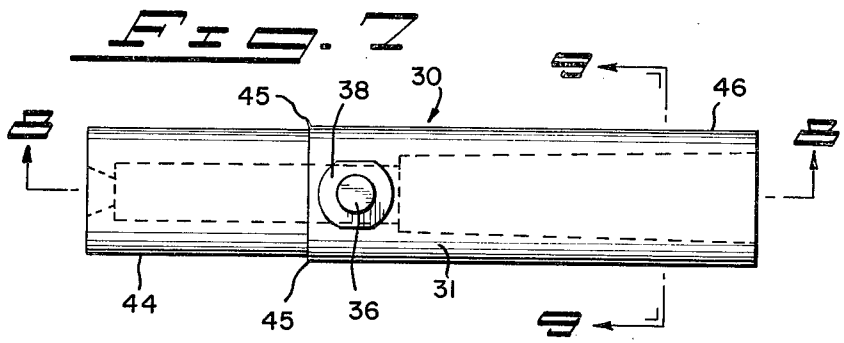
FIG. 7 is a detail plan view of the hub member.
Figure 4:
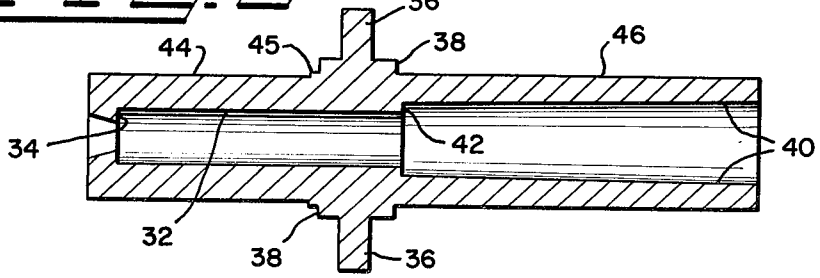
Figure 9:
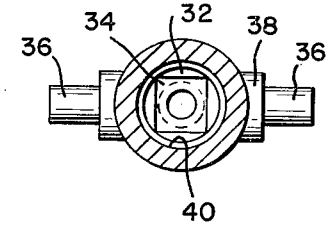
FIG. 9 is a sectional view of the hub member taken along the line 9—9 of FIG. 7.

The details of the structure of hub 30 are illustrated in FIGS. 7, 8 and 9. The hub 30 is generally cylindrical in shape having a pair of pivot pins 36 protruding radially outward from the exterior cylindrical wall 31 of the hub 30. The pivot pins 36 are seated on a mounting base 38, and located 180 degrees apart from each other. The hub 30 is provided with a cylindrical bore 40 which is slightly tapered such that the largest diameter of the bore 40 is located at the opening to the bore 40. The cylindrical bore 40 changes to a rectangular bore 32 in the vicinity of the pivot pins 36 at a point designated 42 in FIG. 8. The tapered cylindrical bore 40 is designed to faciliate insertion of the driven shaft 100 into hub 30. The rectangular bore 32 is sized to mate with the rectangular end 102 of driven shaft 100. The rectangular shape serves to key the hub 30 to driven shaft 100 for unified rotation of the members. The hub 30 is divided into two sections having different outside diameters. The section 44 of reduced outside diameter is sized for mounting in bore 22 of bearing 20. Shoulder 45 defines the transition from the reduced diameter section 44 to section 46 of larger diameter.

The cross-sectional shape of bore 40 and bore 32 are illustrated in FIG. 9. This view shows how the tapered cylindrical bore 40 assists in inserting the end of driven shaft 100 into the rectangular, or in this instance, square bore 32 which is preferably but not necessarily the largest square bore which can fit within the cross-sectional area of the smaller end of the tapered bore 40.

OPERATIONAL DESCRIPTION

It is the purpose of the present invention to convert a force 60 applied to the knob 70, which force may be applied anywhere within a relatively large area and in any of a multitude of directions, including non-radial directions, into a longitudinal displacement of the driven shaft 100 thereby disengaging the driven shaft 100 from the stepping or other motor drive means 150 and permitting free and fine adjustment of the vertical position of the form by rotation of the knob 70. By means of the present invention, the operator of the printing device 6, in which the invention is utilized, can make the fine adjustment by making a single and simple motion which may be effected even by the use of a single finger (or thumb).

The force 60 may be applied over a wide range of locations on the exterior cylindrical surface of knob 70 and certainly over the entire area covered by the ridges 76. The force 60 may also be applied in virtually any direction. The only direction which would not cause the desired disengagement is axially toward the bearing member 20. Because the knob 70 is universally mounted by yoke 50 to hub 30, a force directed in any other direction will cause the free end of knob 70 to pivot about a point 79 toward driven shaft 100 and to be longitudinally displaced as well.

FIG. 2 may be used by way of example to illustrate the operation of the form aligning mechanism 5. Typically, an operator would be seated before the printing device 6, such as a high speed printer, and to fine adjust the vertical position of the form in the printing device 6 the operator would reach forward and apply a force such as 60 to the knob 70 directed radially inward at a point such as 78. This force 60 would produce the following results. The right end of knob 70 would pivot downward about the point 79, which itself would travel slightly up surface 24 of bearing member 20. The pivoting about point 79 would produce a horizontal displacement of the knob 70 toward the right. The horizontal displacement would be transferred through yoke 50 and pivot pins 36 to the hub 30. Hub 30 would therefore also displace horizontally to the right, causing compression of spring 90 which would in turn cause horizontal displacement of driven shaft 100. Horizontal displacement of driven shaft 100 would cause the driven shaft 100 to disengage from the drive means 150, enabling the driven shaft 100 for free rotation. Using the same finger or thumb as above and continuing with the same motion, the operator would then apply a rotational force to knob 70 which would cause a fine adjustment of the vertical position of the form. When the desired fine adjustment was completed, the operator would release knob 70 which would spring back into its normal position due to the biasing force supplied by spring 110.

The above description of the structure and operation of the form aligning mechanism 5 makes it clear that there has thus been effected a form aligning mechanism 5 which can effect a disengagement of the driven shaft 100 and a fine adjustment of the vertical position of a form by a simple and single application of force applied through a single finger (or thumb) of the operator. Additionally, there is no horizontal cross-body application of force required of the operator. Instead the force is applied in any direction convenient to the operator and in a direction generally parallel to the operator's extended arm, thereby avoiding the mechanical disadvantage of the human arm encountered in the application of horizontal forces across the operator's body. It is further clear that the present invention is capable of proper functioning in response to a force 60 applied anywhere within a wide area of the knob 70. It is clear, however, that the greatest mechanical advantage is obtained if the force 60 is applied as near to the free end of the knob 70 as possible. The form aligning mechanism 5 disclosed herein is also capable of effective operation in response to a force 60 applied in nearly any direction.

Having described the structure and principles of operation of the present invention, it will be readily apparent to one of ordinary skill in the art that various changes, modifications and additions may be made without departing from the spirit and scope of the invention as set forth in the following claims.

What is claimed is:

1. A form aligning mechanism for use in a printing device, such as a high speed printer, said printing device comprising a frame and a drive means for rotating a driven shaft so as to advance a form in said printing device, said form aligning mechanism comprising:

a bearing means coupled to the frame of said printing device;

a hub member having a bore therein to receive a portion of said driven shaft, said hub member being connected to said driven shaft so as to rotate as a unit therewith and said hub member mounted for rotation in said bearing means;

a knob means concentrically mounted with respect to said driven shaft and said hub member and joined to said hub member by a universal joint;

said knob means further being biased so as to normally contact said bearing means around the entire perimeter of one end of said knob means such that application of a force to the other end of said knob means pivots said knob means about a point on said one end of said knob means which point moves radially inwardly toward said driven shaft to mechanically translate said force to a longitudinal displacement of the driven shaft thereby disengaging said driven shaft from said drive means and enabling said driven shaft for rotation in response to rotation of said knob means.

2. A form aligning mechanism according to claim 1 wherein said knob means is hollow and provided on its inner surface with two opposed radially inwardly extending pins;

said hub member is provided on its exterior surface with two opposed radially outwardly extending pins;

said form aligning mechanism further comprising an annular yoke having four equally spaced radially extending cradles for receiving said pins, two of said cradles opening in one axial direction and two of said cradles opening in the opposite axial direction;

said radially inwardly extending pins and said radially outwardly extending pins cooperating with said yoke to effect said universal joint between said hub member and knob means.

3. A form aligning mechanism according to claim 2 wherein said two opposed radially inwardly extending pins on said knob means are each provided with a flat surface extending lengthwise along said pins to aid in proper installation of said yoke within said hub member.

* * * * *